US009831552B2

(12) United States Patent
Ridgeway

(10) Patent No.: US 9,831,552 B2
(45) Date of Patent: Nov. 28, 2017

(54) MULTIBAND LOOP ANTENNA

(71) Applicant: Digi International Inc., Minnetonka, MN (US)

(72) Inventor: Robert Wayne Ridgeway, Doonan (AU)

(73) Assignee: Digi International Inc., Minnetonka, MN (US)

( * ) Notice: Subject to any disclaimer, the term of this patent is extended or adjusted under 35 U.S.C. 154(b) by 836 days.

(21) Appl. No.: 13/682,452

(22) Filed: Nov. 20, 2012

(65) Prior Publication Data

US 2013/0135173 A1 May 30, 2013

Related U.S. Application Data

(60) Provisional application No. 61/565,205, filed on Nov. 30, 2011.

(51) Int. Cl.

| | |
|---|---|
| ***H01Q 7/00*** | (2006.01) |
| ***H01Q 5/00*** | (2015.01) |
| ***H01P 11/00*** | (2006.01) |
| ***H01Q 5/357*** | (2015.01) |

(52) U.S. Cl.

CPC ..... *H01Q 5/0027* (2013.01); *H01P 11/00* (2013.01); *H01Q 5/357* (2015.01); *H01Q 7/00* (2013.01); *Y10T 29/49016* (2015.01); *Y10T 29/49018* (2015.01)

(58) Field of Classification Search

USPC ..... 343/867

See application file for complete search history.

(56) References Cited

U.S. PATENT DOCUMENTS

| | | | | |
|---|---|---|---|---|
| 6,603,432 | B2 * | 8/2003 | Hill | H01Q 1/243 343/700 MS |
| 7,639,187 | B2 * | 12/2009 | Caballero | H01Q 1/088 343/702 |
| 7,755,546 | B2 * | 7/2010 | Ishimiya | 343/702 |
| 2009/0121944 | A1 * | 5/2009 | Sotoudeh | 343/702 |

* cited by examiner

*Primary Examiner* — Graham Smith

(74) *Attorney, Agent, or Firm* — Fogg & Powers LLC

(57) ABSTRACT

An approximately planar antenna assembly can be formed or used, such as comprising a printed circuit board assembly. In an example, the approximately planar antenna assembly can include a dielectric material and a conductive loop comprising an outer loop portion having a first conic section an inner loop portion having a second conic section located within a footprint of the first conic section. The planar antenna assembly can be configured to support wireless transfer of information in at least two ranges of operating frequencies, such as two or more respective ranges used for cellular communications.

25 Claims, 8 Drawing Sheets

MULTIBAND LOOP ANTENNA

CROSS-REFERENCE TO RELATED APPLICATIONS

This patent application claims the benefit of priority, under 35 U.S.C. Section 119(e), to U.S. Provisional Patent Application Ser. No. 61/565,205, titled "Multiband Loop Antenna," filed Nov. 30, 2011, and which is hereby incorporated herein by reference in its entirety.

BACKGROUND

Information can be wirelessly transferred using electromagnetic waves. Generally, such electromagnetic waves are either transmitted or received using a specified range of frequencies, such as established by a spectrum allocation authority for a location where a particular wireless device or assembly will be used or manufactured. Such wireless devices or assemblies generally include one or more antennas, and each antenna can be configured for transfer of information at a particular range of frequencies. Such ranges of frequencies can include frequencies used by wireless digital data networking technologies. Such technologies can use, conform to, or otherwise incorporate aspects of one or more other protocols or standards, such as for providing cellular telephone or data services, fixed or mobile terrestrial radio, satellite communications, or other applications.

OVERVIEW

An electronic assembly can be configured to wirelessly transfer information using one or more cellular or mobile communication standards. Generally, such standards and protocols are not uniform across all geographies. Therefore, in one approach, such an electronic assembly is customized to work properly with cellular or mobile data services available in the intended manufacturing or usage location. Such customization can include using different antenna configurations for each geography, or using different matching components for each geography. Such customization involving using different components for different locations can increase inventory carrying and manufacturing costs.

The present inventor has recognized, among other things, that a multi-band antenna can be configured to operate across a wide range of useable operating frequencies, such as including a range from less than about 806 megahertz (MHz) to more than about 2.17 gigahertz (GHz). Such a range of useable operating frequencies can provide worldwide compatibility for such an antenna configuration.

Such an antenna can include an approximately planar loop antenna, such as included as a portion of a printed circuit board assembly (PCBA). Such a planar antenna can be formed (e.g., patterned, etched, deposited, etc.) using a conductive material that can also be used for forming various other electrical or mechanical interconnections of the circuit board. The present invent has recognized, among other things, that such a planar antenna can be cheaper to fabricate or more volumetrically compact as compared to using other antenna configurations.

In an example, a first PCB assembly can include a wireless communication circuit or other components, and the approximately planar loop antenna can be included as a portion of a second PCB assembly. The second PCB assembly can be attached to the first PCB assembly via a connector. For example, the first PCB assembly can include a reference plane, such as configured to provide a counterpoise or return plane for the antenna.

In an example, an approximately planar antenna assembly can include a dielectric material and a conductive loop comprising an outer loop portion having a first conic section an inner loop portion having a second conic section located within a footprint of the first conic section. For example, such a planar antenna assembly can be configured to support wireless transfer of information in at least two non-overlapping ranges of operating frequencies.

This overview is intended to provide an overview of subject matter of the present patent application. It is not intended to provide an exclusive or exhaustive explanation of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
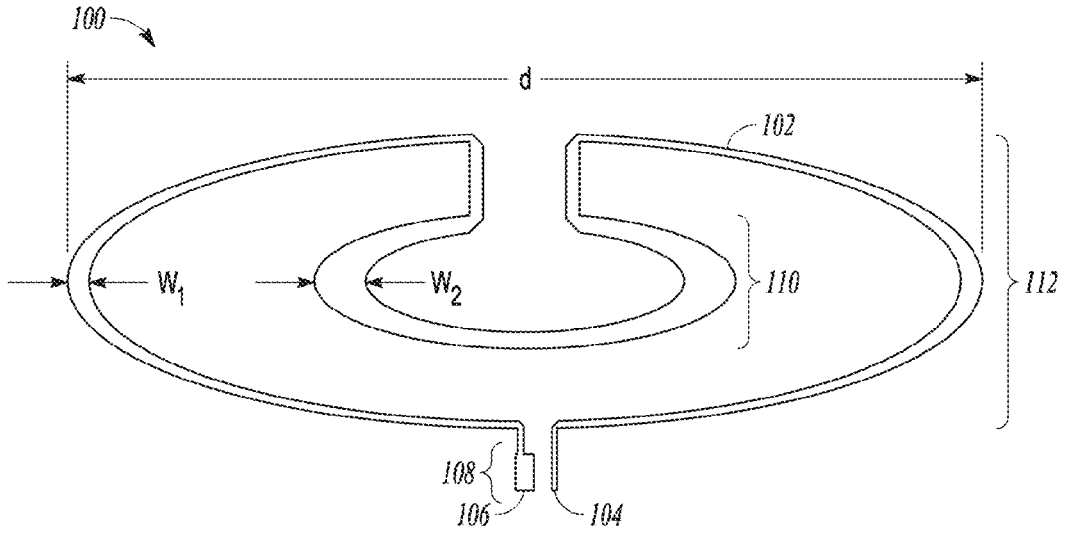
FIG. 1 illustrates generally an example of a planar antenna pattern, such as included as a portion of a PCB assembly.

FIG. 1 illustrates generally an example of a planar antenna pattern 100, such as can be included as a portion of a PCB assembly. The planar antenna pattern 100 can be formed as a conductive portion of the PCB assembly, such as including a conductive loop 102. The conductive loop 102 can include an outer loop portion 112 comprising a first conic section, and an inner loop portion 110 comprising a second conic section. In the example of FIG. 1, the first and second conic sections are elliptical, but can include other shapes, such as including a parabolic portion or a hyperbolic portion, or one or more other shapes. For example, as shown in FIG. 1 and in other examples below, the inner loop portion 110 can be located within a "footprint" bounded by the outer loop portion 112. The planar antenna pattern 100 need not be absolutely planar, and can be formed as a portion of a flexible assembly, or formed as a portion of an assembly including multiple layers.

In an example, a lateral width of the conductive loop 102 can vary along the conductive loop 102. In FIG. 1, such a lateral width can be wider in a region along a major axis of the first or second conic sections, such as a first width $w_1$ along a major axis of the outer loop portion 112, or a second width $w_2$ along a major axis of the inner loop portion 110. Such a width can be adjusted to provide a specified input impedance across a specified range of frequencies, such as broadening a usable range of operating frequencies as compared to using a conductive loop 102 having a constant or uniform lateral width.

In an example, the conductive loop 102 can include a first terminal 104, such as configured to be conductively coupled to a signal conductor included as a portion of an electrical connector or other feed, such as a transmission line or waveguide included as a portion of the PCB assembly. The conductive loop 102 can also include a second terminal 106, such as configured to be conductively coupled to a return conductor. One or more discrete or embedded matching components can be included in or nearby a feed region 108 of the planar antenna pattern 100.

In an example, the antenna pattern 100 can be configured to provide two or more specified ranges of operating frequencies, such as two different or two non-overlapping usable ranges of operating frequencies. For example, the antenna pattern 100 can provide a first usable operating frequency range meeting a specified return loss criterion, and a different second usable operating frequency range (e.g., a higher or "upper" frequency range), such as shown in the illustrative example of FIG. 4.

Figure 4:
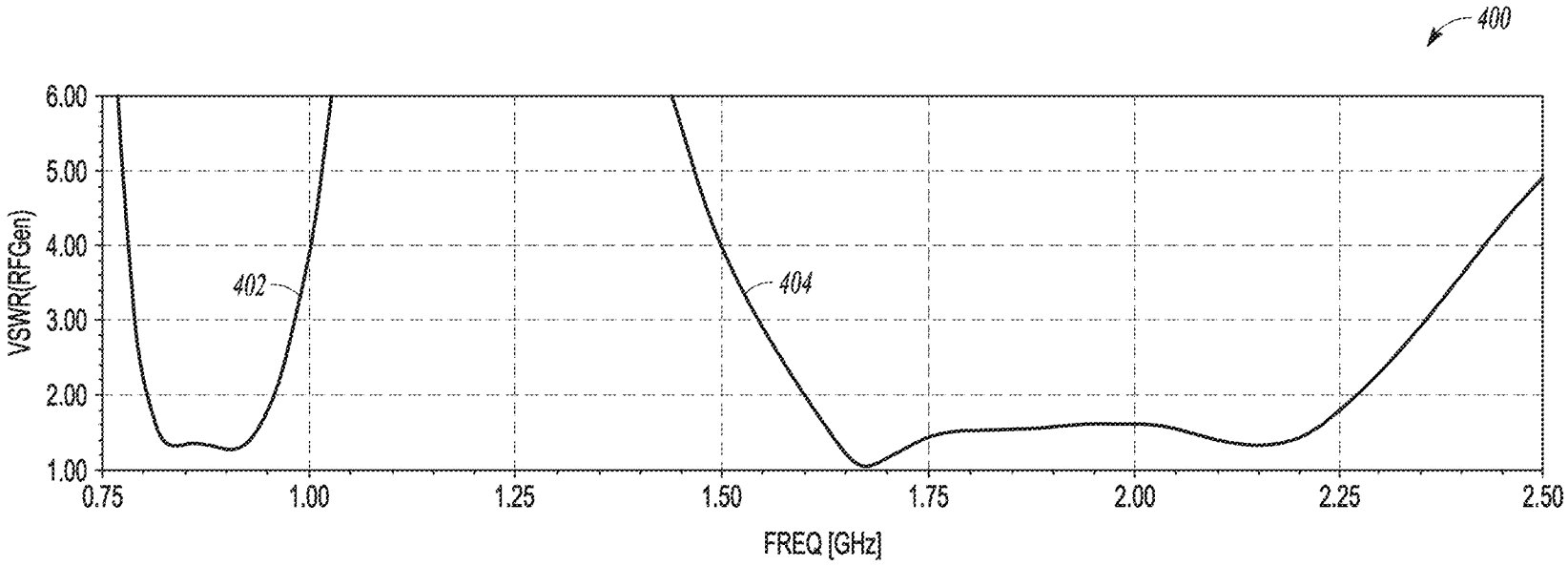
FIG. 4 illustrates generally an illustrative example of a voltage standing wave ratio (VSWR) simulated for the antenna configuration of FIG. 1.

A dimension of the major axis of the outer loop portion 112 can be represented by "d," and can be used to establish a center frequency of an upper band, such as including the second usable operating frequency range. In an illustrative example, if the antenna pattern 100 includes a conductive loop 102 backed by a dielectric material including a glass epoxy laminate, a dimension of 2.52 inches can provide a second usable operating frequency range from about 1.575 gigahertz (GHz) to about 2.170 GHz, such as shown in FIG. 4.

Figure 2:
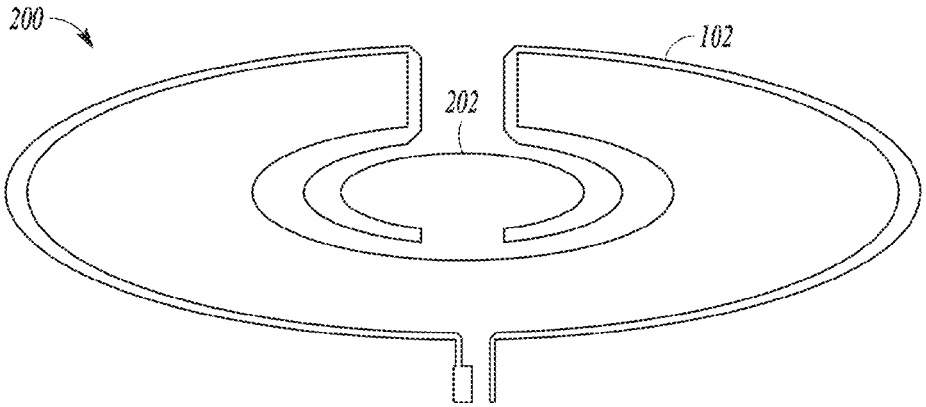
FIG. 2 illustrates generally an example of a planar antenna pattern, such as included as a portion of a PCB assembly.

FIG. 2 illustrates generally an example of a planar antenna pattern 200, such as can be included as a portion of a PCB assembly. In an example, a conductive loop 102, similar to the conductive loop 102 of FIG. 1, can include a stub 202. The stub 202 can be sized and shaped to tune an antenna assembly including the conductive loop 102, such as to adjust one or more of an input impedance or a specified usable range of frequencies.

Figure 3A:
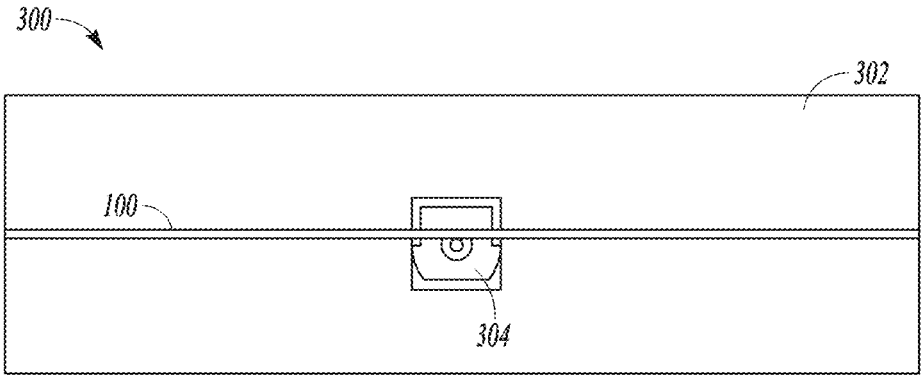
FIGS. 3A through 3C illustrate generally views of an example of a planar antenna assembly electrically and mechanically coupled to a PCB assembly.
Figure 3B:
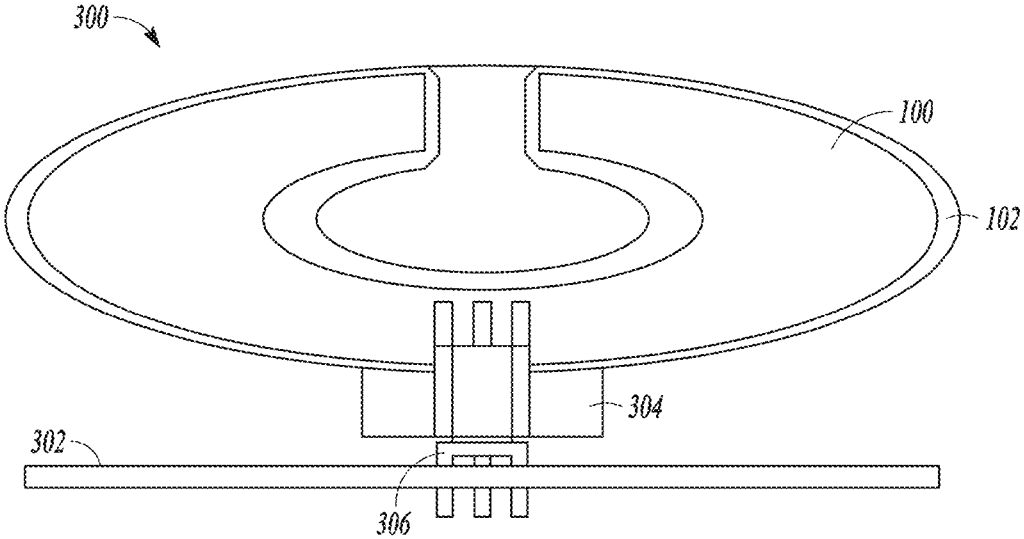
Figure 3C:
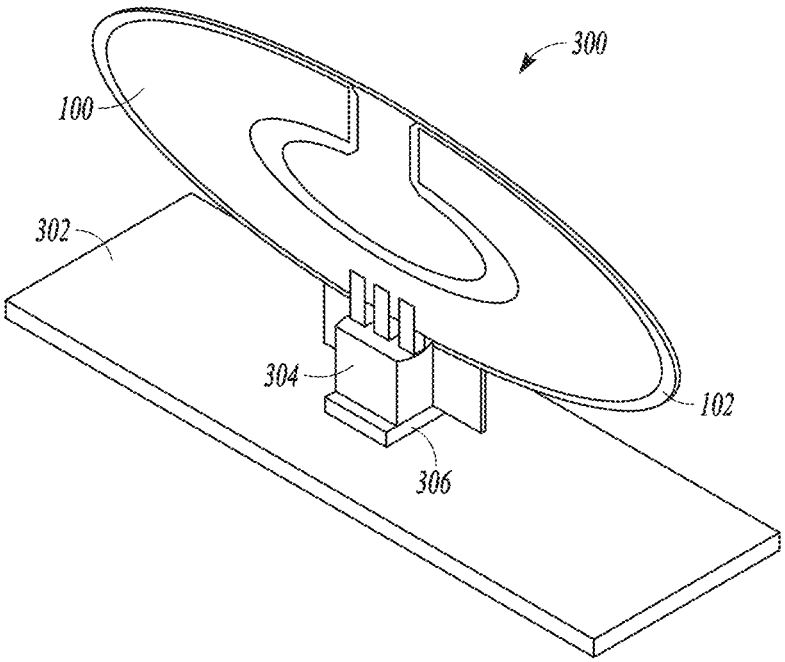

FIGS. 3A through 3C illustrate generally views of an example 300 of a planar antenna assembly 100 that can be electrically and mechanically coupled to a PCB assembly 302. In an example, the planar antenna assembly 100 can include a conductive loop 102, such as discussed in the examples above and below.

FIG. 3A illustrates generally an overhead (e.g., plan) view, FIG. 3B illustrates generally a side (e.g., elevation) view, and FIG. 3 illustrates generally a isometric view. In an example, the PCB assembly 302 can include a first PCB assembly comprising an electrical connector 306, such as including a through-hole MCX connector, or one or more other connectors (e.g., a connector suitable for a radio frequency (RF) application). Such a connector can be configured to mechanically and electrically couple a second PCB assembly, such as the planar antenna assembly 100, to the first PCB assembly 302, such as using a mating connector 304 that can be included as a portion of the planar antenna assembly 100. Such a mating connector can include an end-launch configuration, such as to orient the planar antenna assembly 100 at an approximately ninety-degree angle (or in another specified orientation) with respect to the first PCB assembly 302.

In an example, the first PCB assembly 302 can include a conductive layer or plane region (e.g., a solid conductive sheet, or other conductive pattern such as a grid, or other pattern) such as coupled to one or more outer conductive portions of the electrical connector 306, such as to provide a reference plane or counterpoise for the planar antenna 100.

In an example, one or more of the first PCB assembly 302 or the planar antenna assembly 100 can include a dielectric material. Such a dielectric material can include a glass-epoxy laminate such as FR-4, or one or more other materials, such as generally used in PCB fabrication. Such materials can include a bismaleimide-triazine (BT) material, a cyanate ester, a polyimide material, or a polytetrafluoroethylene material, or one or more other materials. One or more of the conductive portions of the first PCB assembly 302 or the planar antenna assembly 100 can include electrodeposited or rolled-annealed copper or another conductive material. Such conductive portions can be patterned using a photolithographic process, or formed using one or more other techniques (e.g., a deposition, a stamping, etc.).

FIG. 4 illustrates generally an illustrative example of a voltage standing wave ratio (VSWR) 400 simulated for the antenna configuration of FIG. 1. A usable range of operating frequencies can be specified in terms of VSWR, or in terms of a corresponding return loss, or using one or more other criteria. For example, a specified $S_{11}$ parameter of about −6 dB or lower (e.g., a return loss of 6 dB), can be considered generally acceptable for a cellular or mobile data application. Such a return loss corresponds to a VSWR of 3:1 or less (e.g., about 3.01 or less as indicated in FIG. 4).

In FIG. 4, the simulated antenna can provide two or more usable ranges of operating frequencies, such as a first region 402 covering a range from less than about 806 MHz to more than 960 MHz, or a second region 404 covering a range from less than about 1.575 GHz to more than about 2.170 GHz. Other ranges can be used, such as one or more sub-ranges within the first range 402, or the second range 404, or by changing one or more dimensions of conductive loop pattern of the antenna (e.g., such as increasing a major dimension of one or more conic portions to shift a range of operating frequencies lower or vice versa). In the example of FIG. 4, the usable operating frequency ranges are non-overlapping, because there is a region of high VSWR between the first range 402 and the second range 404.

Other criteria can also be used, such as a return loss of 10 dB or better (corresponding to a VSWR of 2:1 or less), or using one or more other values, with a corresponding improvement in link budget due to reduced mismatch loss, but at a corresponding cost in terms of manufacturing yield or usable bandwidth.

In an example, a first specified range of operating frequencies can include one or more cellular communications frequency ranges, such as a Global System for Mobile communication (GSM) range of frequencies, such as including one or more of T-GSM-810, GSM-850, P-GSM-900, E-GSM-900, R-GSM-900, or T-GSM-900, such as including a range of about 806 MHz to about 960 MHz. A second, different, specified range of operating frequencies can include one or more other cellular communications frequency ranges, such as including one or more of DCS-1800 or PCS-1900, such as including a range from about 1710 MHz to about 1990 MHz, or including one more or other ranges.

Figure 5:
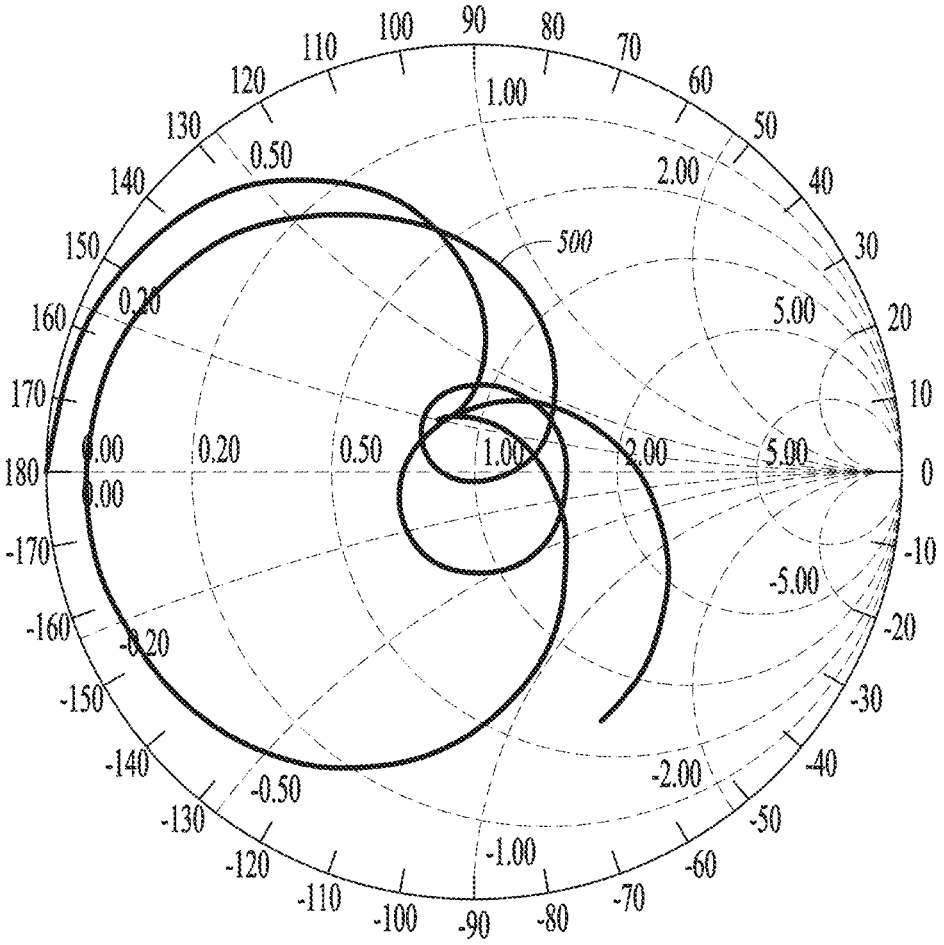
FIG. 5 illustrates generally an illustrative example of an impedance Smith Chart simulated for the antenna configuration of FIG. 1.

FIG. 5 illustrates generally an illustrative example of an impedance Smith Chart 500 simulated for the antenna configuration of FIG. 1. In the example of FIG. 5, loops in the impedance response can be provided by a multiply-resonant antenna structure, such as shown in the simulated return loss of the illustrative example of FIG. 4. In the example of FIG. 5, loops in the impedance response encircle the center or unit impedance of the chart (e.g., corresponding to 50 ohms real impedance).

As discussed above, the geometry of the conductive loop portions (e.g., a dimension of an inner or outer conic portion, or a lateral width of the conductive strip forming the loop, or one or more other physical parameters) can be adjusted, such as parametrically studied via simulation to achieve a desired input impedance range. In the case where the desired input impedance is not easily achieved, a matching structure such as one or more discrete or distributed matching components can be used to minimize or reduce the impedance discontinuity between the antenna and a wireless communication circuit coupled to the antenna via the matching structure, or to adjust the input impedance presented to the wireless communication circuit.

Figure 6:
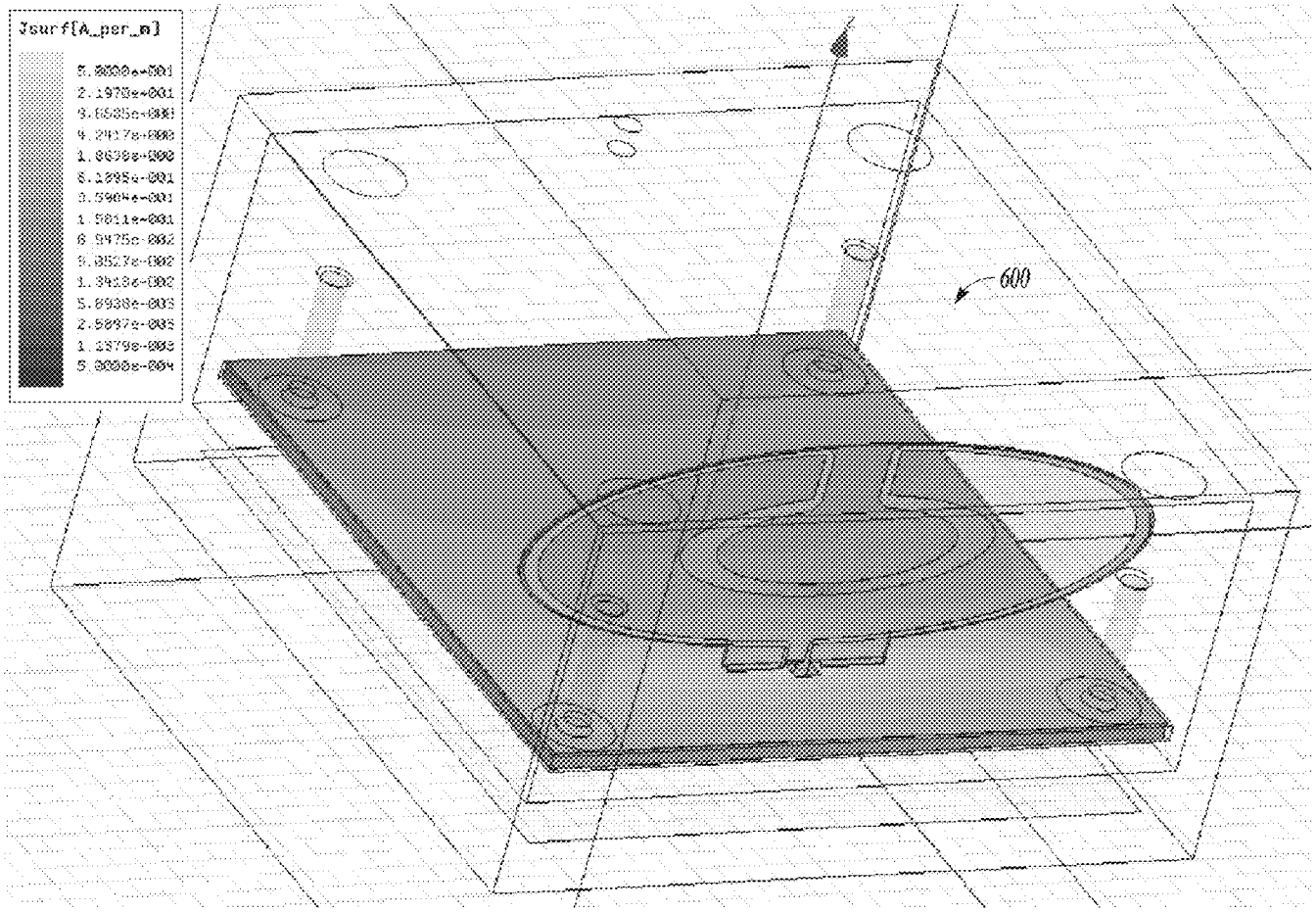
FIG. 6 illustrates generally an illustrative example of a surface current density simulated for the antenna configuration of FIG. 1 at a frequency of 880 megahertz (MHz).

FIG. 6 illustrates generally an illustrative example 600 of a surface current density simulated for the antenna configuration of FIG. 1 at a frequency of 880 megahertz (MHz). In FIG. 6, the antenna is located at a ninety degree angle with respect to a reference plane provided by a separate circuit assembly. Such an antenna orientation can improve radiation efficiency as compared to placing the antenna assembly parallel to the reference plane. For example, a simulated radiation efficiency for antenna configuration of FIG. 6 is about 90% at 880 MHz.

Figure 7:
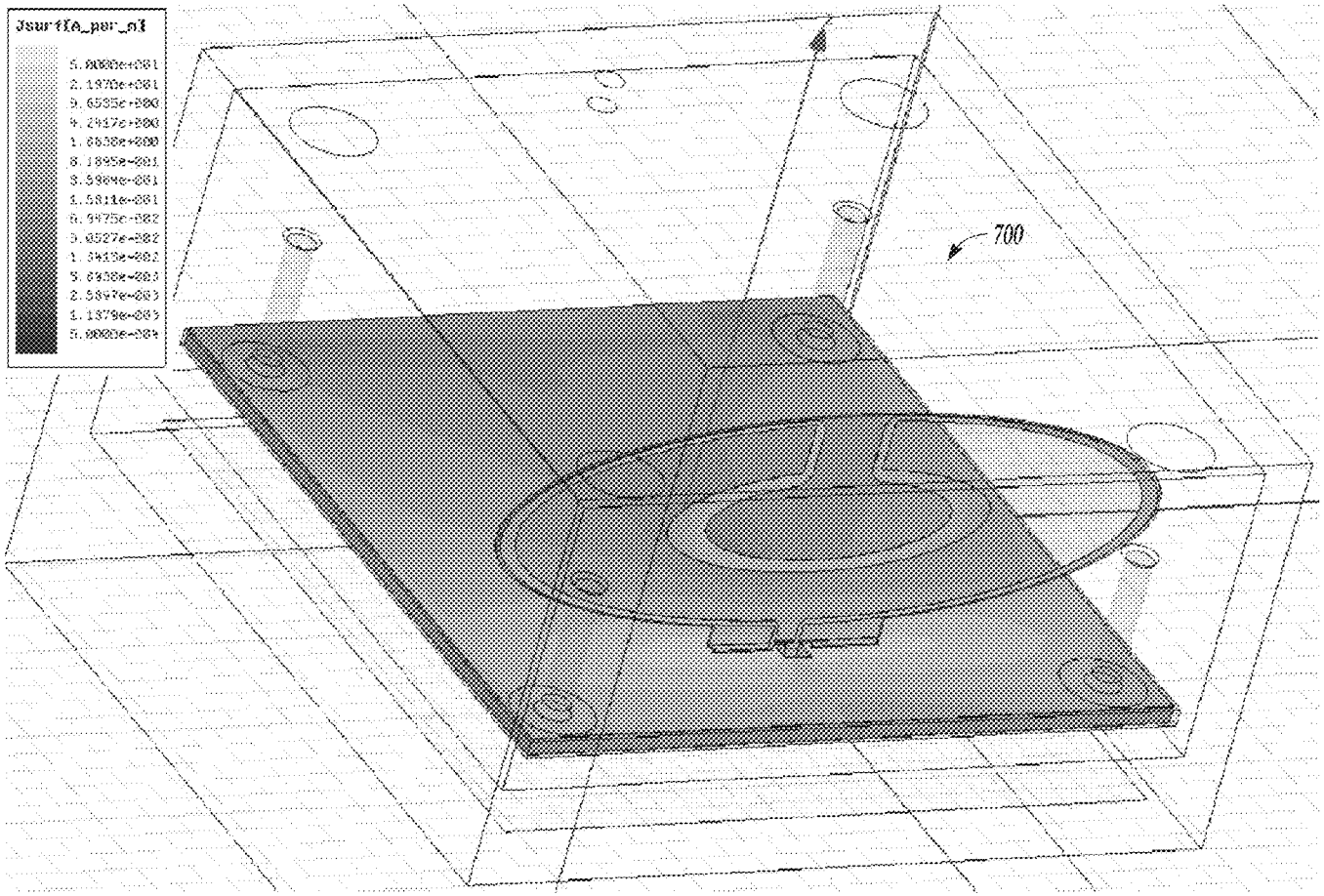
FIG. 7 illustrates generally an illustrative example of a surface current density simulated for the antenna configuration of FIG. 1 at a frequency of 1710 megahertz (MHz).

FIG. 7 illustrates generally an illustrative example of a surface current density simulated for the antenna configuration of FIG. 1 at a frequency of 1710 megahertz (MHz). In FIG. 7, the antenna is located at a ninety degree angle with respect to a reference plane provided by a separate circuit assembly, similar to the configuration shown in FIG. 6. A simulated radiation efficiency for antenna configuration of FIG. 6 is about 93% at 1710 MHz.

Figure 8:
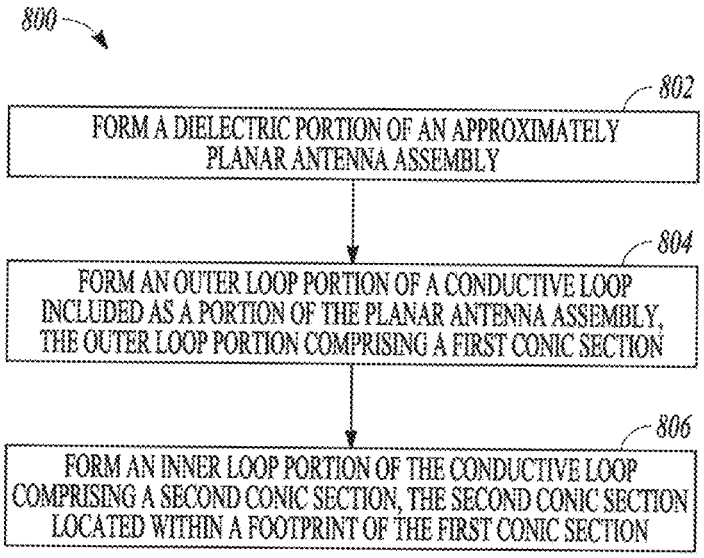
FIG. 8 illustrates generally a technique 800, such as a method, that can include forming a first PCB assembly.

FIG. 8 illustrates generally a technique 800, such as a method, that can include forming an approximately planar antenna assembly. At 802, a dielectric material can be formed, such as a printed circuit board substrate material (e.g., a glass-epoxy material, or one or more other materials). A conductive loop can be formed, such as on a surface or interior layer of the dielectric material, such as including at 804, forming an outer loop portion comprising a first conic section, and at 806, forming an inner loop portion comprising a second conic section located within a footprint of the first conic section. The planar antenna can be configured to support wireless transfer of information in at least two ranges of operating frequencies, such as including two different ranges of cellular communications operating frequencies.

VARIOUS NOTES & EXAMPLES

Example 1 includes subject matter, such as apparatus, comprising an approximately planar antenna assembly, the approximately planar antenna assembly comprising: a dielectric material and a conductive loop including an outer loop portion comprising a first conic section and an inner loop portion comprising a second conic section located within a footprint of the first conic section. In Example 1, the planar antenna assembly is configured to support wireless transfer of information in at least two ranges of operating frequencies, one or more of the first or second conic sections including an elliptical shape, a line width of the conductive loop varying along the conductive loop, a lateral width of the conductive loop is widest in a region along a major axis of the first or second conic section, and the approximately planar antenna assembly configured to support wireless transfer of information within two different specified ranges of operating frequencies, the specified ranges of operating frequencies comprising two different ranges of cellular communications operating frequencies.

In Example 2, the subject matter of Example 1 can optionally include two different specified ranges of operating frequencies including a first range from 806 MHz to about 960 MHz, and a second range from about 1.575 GHz to about 2.170 GHz.

Example 3 includes subject matter, such as apparatus, comprising an approximately planar antenna assembly, the approximately planar antenna assembly comprising a dielectric material, and a conductive loop comprising an outer loop portion including a first conic section and an inner loop portion including a second conic section located within a footprint of the first conic section, the planar antenna assembly is configured to support wireless transfer of information in at least two ranges of operating frequencies.

In Example 4, the subject matter of Example 3 can optionally include two ranges of operating frequencies, comprising two different ranges of cellular communications operating frequencies.

In Example 5, the subject matter of one or any combination of Examples 3 through 4 can optionally include one or more of the first or second conic sections comprising an elliptical shape.

In Example 6, the subject matter of one or any combination of Examples 3 through 5 can optionally include a lateral width of the conductive loop that is widest in a region along a major axis of the first or second conic section.

In Example 7, the subject matter of one or any combination of Examples 3 through 6 can optionally include a line width of the conductive loop varying along the conductive loop.

In Example 8, the subject matter of one or any combination of Examples 3 through 7 can optionally include a first printed circuit board (PCB) assembly including a connector, the approximately planar antenna assembly including a second PCB assembly configured to be electrically and mechanically coupled to the first PCB via the connector.

In Example 9, the subject matter of one or any combination of Examples 3 through 8 can optionally include a first PCB assembly comprising a planar conductive region electrically coupled to a terminal of the conductive loop, the planar conductive region configured to provide a reference plane for the approximately planar antenna.

In Example 10, the subject matter of one or any combination of Examples 3 through 9 can optionally include a second PCB assembly configured to be located in an orientation that is non-parallel to the reference plane.

In Example 11, the subject matter of one or any combination of Examples 3 through 10 can optionally include an approximately planar antenna assembly configured to support wireless transfer of information within at least two non-overlapping ranges of operating frequencies.

In Example 12, the subject matter of one or any combination of Examples 3 through 11 can optionally include an approximately planar antenna assembly configured to support wireless transfer of information within a first specified range of frequencies between about 806 megahertz (MHz) and about 960 MHz, and to support wireless transfer of information within a second specified range of frequencies between about 1.575 gigahertz (GHz) and about 2.170 GHz.

In Example 13, the subject matter of one or any combination of Examples 3 through 12 can optionally include a dimension of a major axis of the outer loop portion configured at least in part to determine the second specified range of operating frequencies.

In Example 14, the subject matter of one or any combination of Examples 3 through 13 can optionally include a rigid dielectric material, wherein the second PCB assembly including at least a portion comprising a flexible dielectric material, and wherein at least a portion of the second PCB includes a rigid dielectric material.

In Example 15, the subject matter of one or any combination of Examples 3 through 14 can optionally include a stub coupled to the inner loop portion.

In Example 16, the subject matter of one or any combination of Examples 3 through 15 can optionally include a stub comprising a third conic section.

Example 17 can include, or can optionally be combined with the subject matter of one or any combination of Examples 1-16 to include, subject matter (such as a method, a means for performing acts, or a machine-readable medium including instructions that, when performed by the machine, cause the machine to perform acts) comprising forming an approximately planar antenna assembly including forming a dielectric material and forming conductive loop comprising an outer loop portion comprising a first conic section and an inner loop portion comprising a second conic section located within a footprint of the first conic section, the planar antenna assembly configured to support wireless transfer of information in at least two ranges of operating frequencies.

In Example 18, the subject matter of Example 17 can optionally include one or more of the first or second conic sections comprising an elliptical shape.

In Example 19, the subject matter of one or any combination of Examples 17 through 18 can optionally include a lateral width of the conductive loop widest in a region along a major axis of the first or second conic section.

In Example 20, the subject matter of one or any combination of Examples 17 through 19 can optionally include a line width of the conductive loop that varies along the conductive loop.

In Example 21, the subject matter of one or any combination of Examples 17 through 20 can optionally include forming a first printed circuit board (PCB) assembly including a connector, the approximately planar antenna assembly comprising a second PCB assembly configured to be electrically and mechanically coupled to the first PCB via the connector.

In Example 22, the subject matter of one or any combination of Examples 17 through 21 can optionally include forming the first PCB assembly including forming a planar conductive region electrically coupled to a terminal of the conductive loop, the planar conductive region configured to provide a reference plane for the approximately planar antenna.

In Example 23, the subject matter of one or any combination of Examples 17 through 22 can optionally include a second PCB assembly configured to be located in an orientation that is non-parallel to the reference plane when the second PCB assembly is mechanically coupled to the first PCB assembly.

In Example 24, the subject matter of one or any combination of Examples 17 through 23 can optionally include a first PCB assembly comprising a rigid dielectric material, the second PCB assembly including at least a portion comprising a flexible dielectric material, and at least a portion of the second PCB including a rigid dielectric material.

In Example 25, the subject matter of one or any combination of Examples 17 through 24 can optionally include two ranges of operating frequencies comprising two different ranges of cellular communications operating frequencies.

Example 26 can include, or can optionally be combined with any portion or combination of any portions of any one or more of Examples 1-25 to include, subject matter that can include means for performing any one or more of the functions of Examples 1-25, or a machine-readable medium including instructions that, when performed by a machine, cause the machine to perform any one or more of the functions of Examples 1-25.

These non-limiting examples can be combined in any permutation or combination.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Method examples described herein can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code may form portions of computer program products. Further, in an example, the code can be tangibly stored on one or more volatile, non-transitory, or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. §1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The claimed invention is:

1. An apparatus comprising an approximately planar antenna assembly, the approximately planar antenna assembly comprising:

a substrate comprising a dielectric material; and a conductive loop coupled to the substrate, the conductive loop having a first end and an opposing second end, the conductive loop comprising:

an outer loop portion comprising a first conic section; and an inner loop portion comprising a second conic section located within a footprint of the first conic section;

wherein the outer loop portion includes a first terminal at the first end of the conductive loop and a second terminal at the second end of the conductive loop;

wherein the planar antenna assembly is configured to support wireless transfer of information in at least two ranges of operating frequencies;

wherein one or more of the first or second conic sections includes an elliptical shape;

wherein a line width of the conductive loop varies along the conductive loop;

wherein a lateral width of the conductive loop is widest in a region along a major axis of the first or second conic section; and wherein the approximately planar antenna assembly is configured to support wireless transfer of information within two different specified ranges of operating frequencies, the specified ranges of operating frequencies comprising two different ranges of cellular communications operating frequencies.

2. The apparatus of claim 1, wherein the two different specified ranges of operating frequencies include:

a first range from about 806 MHz to about 960 MHz; and a second range from about 1.575 GHz to about 2.170 GHz;

wherein the ranges of operating frequencies each have a voltage standing wave ratio (VSWR) of about 3:1 or less.

3. An apparatus comprising an approximately planar antenna assembly, the approximately planar antenna assembly comprising:

a dielectric material substrate; and a conductive loop coupled to the dielectric material substrate, the conductive loop having a first end and a second end, the conductive loop comprising:

an outer loop portion comprising a first conic section; and an inner loop portion comprising a second conic section located within a footprint of the first conic section;

wherein the outer loop portion includes a first terminal at the first end of the conductive loop and a second terminal at the second end of the conductive loop;

wherein the planar antenna assembly is configured to support wireless transfer of information in at least two ranges of operating frequencies; and wherein the ranges of operating frequencies each have a voltage standing wave ratio (VSWR) of about 3:1 or less.

4. The apparatus of claim 3, wherein the two ranges of operating frequencies comprise two different ranges of cellular communications operating frequencies.

5. The apparatus of claim 3, wherein one or more of the first or second conic sections includes an elliptical shape.

6. The apparatus of claim 5, wherein a lateral width of the conductive loop is widest in a region along a major axis of the first or second conic section.

7. The apparatus of claim 3, wherein a line width of the conductive loop varies along the conductive loop.

8. The apparatus of claim 3, further comprising a first printed circuit board (PCB) assembly including a connector; and wherein the approximately planar antenna assembly comprises a second PCB assembly configured to be electrically and mechanically coupled to the first PCB assembly via the connector.

9. The apparatus of claim 8, wherein the first PCB assembly includes a planar conductive region electrically coupled to the first and second terminals of the conductive loop, the planar conductive region configured to provide a reference plane for the approximately planar antenna.

10. The apparatus of claim 9, wherein the second PCB assembly is configured to be located in an orientation that is non-parallel to the reference plane.

11. The apparatus of claim 3, wherein the approximately planar antenna assembly is configured to support wireless transfer of information within at least two non-overlapping ranges of operating frequencies.

12. The apparatus of claim 3, wherein the approximately planar antenna assembly is configured to support wireless transfer of information within a first specified range of operating frequencies between about 806 MHz and about 960 MHz, and to support wireless transfer of information within a second specified range of operating frequencies between about 1.575 GHz and about 2.170 GHz;

wherein the ranges of operating frequencies each have a VSWR of about 2:1 or less.

13. The apparatus of claim 12, wherein a dimension of a major axis of the outer loop portion is configured at least in part to determine the second specified range of operating frequencies.

14. The apparatus of claim 8, wherein the first PCB assembly includes a rigid dielectric material, wherein the second PCB assembly includes a portion comprising a flexible dielectric material, and wherein a portion of the second PCB assembly includes a rigid dielectric material.

15. The apparatus of claim 3, further comprising a stub coupled to the inner loop portion.

16. The apparatus of claim 15, wherein the stub comprises a third conic section.

17. A method, comprising:

forming an approximately planar antenna assembly including:

forming a dielectric material substrate; and forming a conductive loop coupled to the dielectric material substrate, the conductive loop having a first end and a second end, the conductive loop comprising:

an outer loop portion comprising a first conic section; and an inner loop portion comprising a second conic section located within a footprint of the first conic section;

wherein the outer loop portion includes a first terminal at the first end of the conductive loop and a second terminal at the second end of the conductive loop;

wherein the planar antenna assembly is configured to support wireless transfer of information in at least two ranges of operating frequencies; and wherein the ranges of operating frequencies each have a voltage standing wave ratio (VSWR) of about 3:1 or less.

18. The method of claim 17, wherein one or more of the first or second conic sections includes an elliptical shape.

19. The method of claim 18, wherein a lateral width of the conductive loop is widest in a region along a major axis of the first or second conic section.

20. The method of claim 17, wherein a line width of the conductive loop varies along the conductive loop.

21. The method of claim 17, further comprising forming a first printed circuit board (PCB) assembly including a connector; and wherein the approximately planar antenna assembly comprises a second PCB assembly configured to be electrically and mechanically coupled to the first PCB assembly via the connector.

22. The method of claim 21, wherein the forming the first PCB assembly includes forming a planar conductive region electrically coupled to the first and second terminals of the conductive loop, the planar conductive region configured to provide a reference plane for the approximately planar antenna.

23. The method of claim 22, wherein the second PCB assembly is configured to be located in an orientation that is non-parallel to the reference plane when the second PCB assembly is mechanically coupled to the first PCB assembly.

24. The method of claim 21, wherein the first PCB assembly includes a rigid dielectric material, wherein the second PCB assembly includes a portion comprising a flexible dielectric material, and wherein a portion of the second PCB assembly includes a rigid dielectric material.

25. The method of claim 17, wherein the two ranges of operating frequencies comprise two different ranges of cellular communications operating frequencies.

* * * * *